US012325964B2

(12) United States Patent
Ingleby et al.

(10) Patent No.: US 12,325,964 B2
(45) Date of Patent: Jun. 10, 2025

(54) MODULAR POST

(71) Applicant: Brady Corporation Limited, Banbury (GB)

(72) Inventors: Paul J. Ingleby, Southam (GB); Alexander James Hinton, Bury (GB); Edward Barnes, Sale (GB); Richard Peter Rorison Sutherland, Kington (GB)

(73) Assignee: Brady Corporation Limited, Banbury (GB)

( * ) Notice: Subject to any disclaimer, the term of this patent is extended or adjusted under 35 U.S.C. 154(b) by 384 days.

(21) Appl. No.: 17/321,051

(22) Filed: May 14, 2021

(65) Prior Publication Data

US 2021/0355642 A1 Nov. 18, 2021

(30) Foreign Application Priority Data

May 15, 2020 (GB) ..... 2007237

(51) Int. Cl.
*E01F 13/02* (2006.01)
*E04H 12/22* (2006.01)
*E04H 12/34* (2006.01)

(52) U.S. Cl.
CPC ..... *E01F 13/028* (2013.01); *E04H 12/2238* (2013.01); *E04H 12/2261* (2013.01); *E04H 12/342* (2013.01)

(58) Field of Classification Search
CPC ..... E01F 13/028; E01F 15/10; E01F 9/00; E04H 12/2238; E04H 12/2261; E04H 12/342
See application file for complete search history.

(56) References Cited

U.S. PATENT DOCUMENTS 3,135,235 A 6/1964 Romano
4,108,311 A * 8/1978 McClendon ..... B60Q 7/005 40/607.1

(Continued)

FOREIGN PATENT DOCUMENTS

DE 20211382 U1 9/2002
FR 2816337 A1 5/2002

(Continued)

OTHER PUBLICATIONS

UK Intellectual Property Office, Search Report, Application No. GB2007237.7, Sep. 30, 2020, 3 pages.

(Continued)

*Primary Examiner* — Daniel J Wiley
(74) *Attorney, Agent, or Firm* — Quarles & Brady LLP

(57) ABSTRACT

A modular post for use in a barrier system comprises a post component and a base. The post component is configured to be attached or attachable on, to or in the base in a deployed configuration. The post component is configured to be housed within the base when the modular post is in a stored configuration. A method of using a modular post suitable for use in a barrier system is also provided. The method comprises providing a post component and a base. The post component is configured to be attached or attachable on, to or in the base in a deployed configuration. The post component is receivable or configured to be housed within the base when the modular post is in a stored configuration.

24 Claims, 14 Drawing Sheets

(56) References Cited

U.S. PATENT DOCUMENTS

| | | | | |
|---|---|---|---|---|
| 4,667,829 | A * | 5/1987 | Edmund-White | G09F 7/00 40/607.04 |
| 5,772,014 | A * | 6/1998 | Jacober | A45C 11/005 150/116 |
| 9,689,647 | B1 * | 6/2017 | Dolgoff | F41J 1/10 |
| 2005/0241068 | A1 * | 11/2005 | Tomcany | A61G 1/04 5/628 |
| 2006/0127176 | A1 | 6/2006 | Tipaldo | |
| 2019/0150608 | A1 * | 5/2019 | Johnson | A47B 3/0912 |

FOREIGN PATENT DOCUMENTS

| | | | |
|---|---|---|---|
| FR | 2978471 | A1 | 2/2013 |
| GB | 2194268 | A | 3/1988 |
| GB | 2387406 | B | 3/2004 |
| WO | 2016064656 | A2 | 4/2016 |

OTHER PUBLICATIONS

Barrier Group, Barrier Group Product Guide, Copyright 2020 Barrier Group Pty. Ltd., pp. 76-101.

Skipper TM, Retractable Barrier Post and Base System, https://www.skippertm.com/product/skipper-retractable-barrier-post-and-base-system/, Copyright 2022 Skipper TM Ltd., 3 pages.

European Patent Office, Extended Search Report, Application No. 21173931.3, Sep. 28, 2021, 8 pages.

* cited by examiner

MODULAR POST

CROSS-REFERENCE TO RELATED APPLICATION

This application claims priority to United Kingdom Patent Application No. 2007237.7 filed May 15, 2020, the contents of which are incorporated herein by reference in their entirety.

FIELD

The present invention relates to a modular post, and in particular but not exclusively to a modular post for use in a barrier system.

BACKGROUND

Barriers are often erected in a temporary capacity as and when required. For example, temporary barriers are often employed for safety purposes to prevent members of the public from entering a potentially unsafe area whilst building or construction work is being undertaken. The barrier may then be removed once the building work has been completed.

However, temporary barriers do not always provide adequate performance in such circumstances. For example, temporary barriers often require a compromise between a number of performance metrics including length, stability, portability, ease of storage and ease of shaping the temporary barrier around hazards or an area to be demarcated.

In particular, some temporary barriers may employ a plurality of posts which act as points between which lengths of barrier can be connected. Posts suitable for use in a barrier system typically comprise a length of post and a base to support the length of post. Whilst using posts may enable a temporary barrier which provides flexibility in terms of a size and/or shape of the barrier formed, such barriers or posts are often difficult or awkward with regard to both ease and efficiency of storage and ease of transport owing to the different shapes of the length of post and the base.

The present invention has been devised with the foregoing in mind.

SUMMARY

According to a first aspect, there is provided a modular post. The modular post may be for use in a barrier system. The modular post may comprise a post component. The modular post may also comprise a base. The post component may be attached or attachable on, to or in the base in a deployed configuration. The post component may be attached or attachable on, to or in a first surface or side of the base for use in a deployed configuration. The post component may away extend from the base in the deployed position. The post component may away extend from the base in the deployed position substantially normally or orthogonally to the base. The post component may be configured to be received or housed within the base when the modular post is in a stored configuration. The post component may be configured to be received or housed within a different e.g. opposite side or surface of the base when the modular post is in a stored configuration. The base may be fully or partially hollow. The post component may be configured to be received or housed within the hollow of the base when the modular post is in a stored configuration. The post component may be configured to be fully received within the confines of the base when the modular post is in a stored configuration.

Locating or nesting the post component within the base when the modular post is in the stored configuration may provide a modular post which can be easily and/or compactly stored. That may enable a greater number of modular posts to be stored in a given space compared to conventional barrier posts. That may also reduce a likelihood of different components of the modular post becoming inadvertently lost or separated from one another during storage or transit.

The post component may be operable in and/or moveable between a first configuration and a second configuration. The post component may be in the first configuration when the modular post is in a deployed configuration. The post component may be in the second configuration when the modular post is in the stored configuration. A size of the post component, for example a length of the post component, may be reduced in the second configuration.

That may enable the post component to be received within the base in the stored configuration without providing a base that is larger than necessary to provide a stabilising function to the modular post in the deployed configuration.

The post component may comprise a plurality of segments. The plurality of segments may be separable from one another. The plurality of segments may be connectable or reconnectable to one another. That may enable the segments to be simply and easily connected to and disconnected from one another to operate or move the post component between the first configuration and the second configuration. Alternatively, the plurality of segments may not be separable from one another. For example, the post component may comprise a telescopic structure. The telescopic structure may enable the post component to be operated or moved between the first configuration and the second configuration without separating the segments from one another.

Each segment of the post component may be configured to be received within the base separately when the modular post is in the stored configuration. That may enable each segment of the post component to be easily located and accounted for when placing the modular post in the stored configuration.

The plurality of segments may be interchangeably connectable to one another. That may enable the segments to be connected to one another in any order to place the post component in the first configuration. That may increase ease of operation of the modular post. That may also enable the post component to be utilised without employing all available segments. That advantageously provides for altering the length of the post component to tailor it for different uses.

The plurality of segments may comprise a single type of segment. Alternatively, the plurality of segments may comprise two or more different types of segments. The plurality of segments may comprise a plurality of different types of segments each configured to provide a different functionality. That may enable one or more functions or properties of the modular post to be tailored to specific requirements.

The base may comprise at least one recess or opening. The at least one recess may have or comprise a shape substantially corresponding to at least a part of a shape of the post component or segment. That may substantially inhibit or prevent the post component/segment from moving within the base when the modular post is in the stored configuration, which may provide increased ease and comfort for a user. The at least one recess may be configured to form a friction fit with the post component when the post component/segment is received within the base. That may enable the post component/segment to be securely received within the base when the modular post is in the stored configuration. The recess or opening may additionally or alternatively be provided with one or more retention features to retain the post component/segment within the base. The one or more retention features may be or comprise a lip or flange or the like. The one or more retention features may be flexible and/or deformable to permit insertion and/or removal of the post component/segment into/from the base.

The post component may comprise at least one retractable barrier unit. The at least one retractable barrier unit may be configured to connect to one or more other posts. The at least one retractable barrier unit may be or comprise a retractable tape unit. The at least one retractable barrier unit may enable the modular post to be quickly and simply connected to one or more fixing points, for example one or more other posts, to form a barrier.

The post component may comprise a plurality of retractable barrier units. Each of the retractable barrier units may be disposed on or contained in a separate segment of the post component. The post component may therefore be configured to provide a modular post having a retractable barrier unit at a plurality of heights (for example, at a plurality of locations along a length or height of the post component in the first configuration). That may increase difficulty of passing under or through a barrier comprising one or more modular posts, improving performance of the barrier. The retractable barrier unit may be configured for use other than with the modular post, and may provide a further aspect of the invention.

The base may be weighted. That may increase stability of the modular post when the modular post is in the deployed configuration. That may lower a centre of mass of the modular post and may reduce a likelihood of the modular post tipping over if it is inadvertently knocked or subjected to inclement weather, such as strong wind or rain.

The base may comprise an integral weight. That may provide a weighted base in a simple manner. Alternatively, the modular post may comprise a weight configured to be received within the base. The weight may be separable from the base. That may enable the weight to be removed from the modular post if required, for example if the modular post is used in circumstances where the weight is not necessary.

The base may comprise one or more handles. That may provide increased portability of the modular post in the stored configuration.

The modular post may comprise a securing means to retain the post component within the base when the modular post is in the stored configuration. That may further reduce a risk of components of the modular post becoming inadvertently separated from one another during storage or transit.

The securing means may comprise one or more elasticated members. That may enable the securing means to be quickly and easily applied, improve ease of use and reducing effort for a user.

According to a second aspect there is provided a barrier system comprising the modular post of the first aspect and one or more other posts, which may also be a modular post according to the first aspect. The barrier system may comprise one or more barrier members extending between adjacent posts. The one or more barrier members may be retractable barrier units described above.

According to a third aspect, there is provided a method of using a modular post suitable for use in a barrier system. The modular post may be the modular post of the first aspect. The method may comprise providing a post component and a base. The post component may be configured to be attached or attachable on, to or in the base in a deployed configuration. The post component may be receivable or configured to be housed within the base when the modular post is in a stored configuration.

The method may comprise moving the modular post between a first configuration in which the modular post is in the deployed configuration, and a second configuration in which the modular post is in the stored configuration.

The method may comprise separating the post component into a plurality of post component segments and optionally storing each segment of the post component within the base separately when the modular post is in the stored configuration.

The method may comprise providing at least one retractable barrier unit configured to connect to one or more other posts. The at least one retractable barrier unit may comprise a retractable tape unit.

The method may comprise weighting the base.

The method may comprise securing the post component within the base when the modular post is in the stored configuration.

Optional features may be combined in any combination, and these embodiments are specifically envisaged. Features which are described in the context of separate aspects and embodiments of the invention may be used together and/or be interchangeable wherever possible. Features of the first, second and third aspects and their embodiments may be interchangeable. Similarly, where features are, for brevity, described in the context of a single embodiment, those features may also be provided separately or in any suitable sub-combination.

BRIEF DESCRIPTION OF DRAWINGS

The invention will now be described by way of example only with reference to the accompanying drawings in which.

Like reference numbers and designations in the various drawings may indicate like elements.

DETAILED DESCRIPTION

Figure 1A:
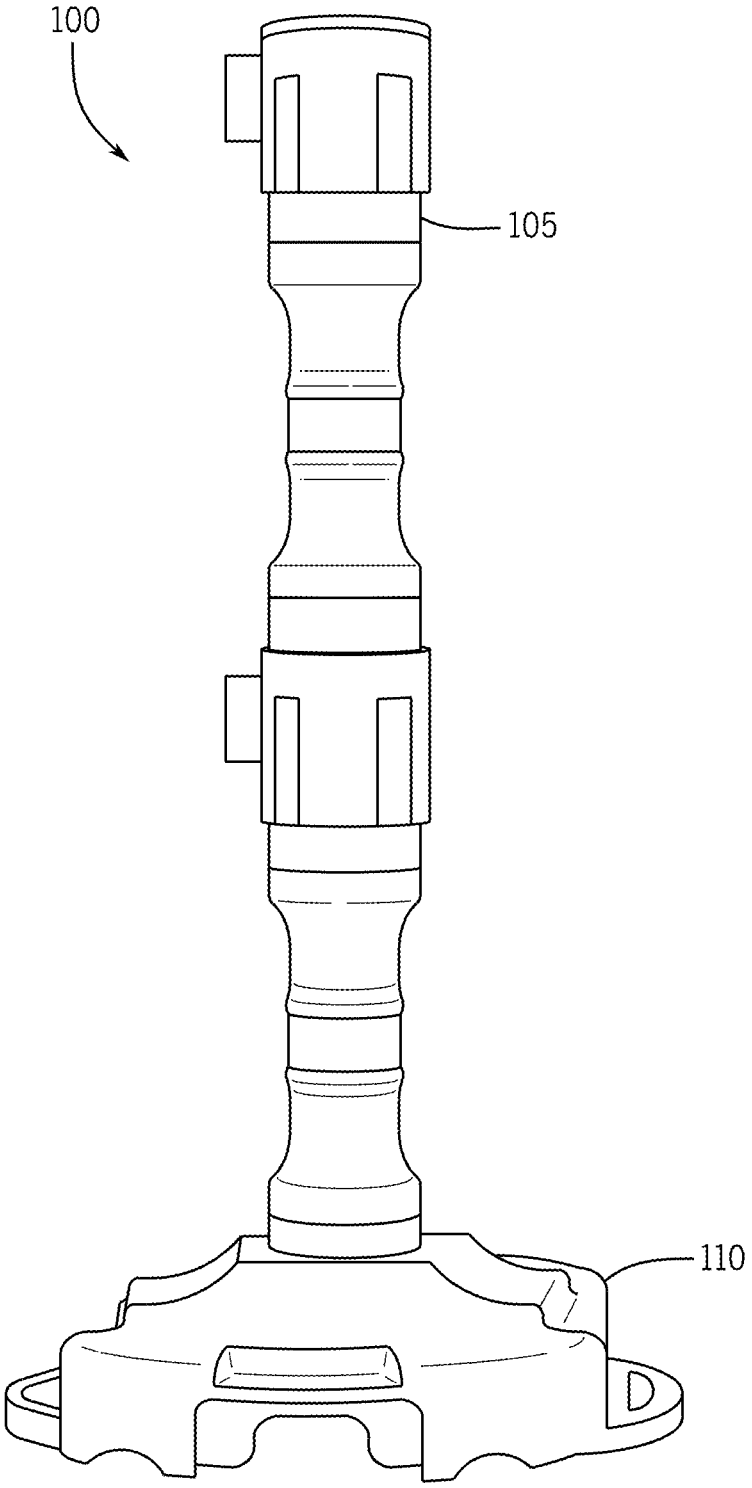
FIGS. 1A and 1B show an embodiment of a modular post in accordance with the invention in both a deployed configuration and a stored configuration.
Figure 1B:
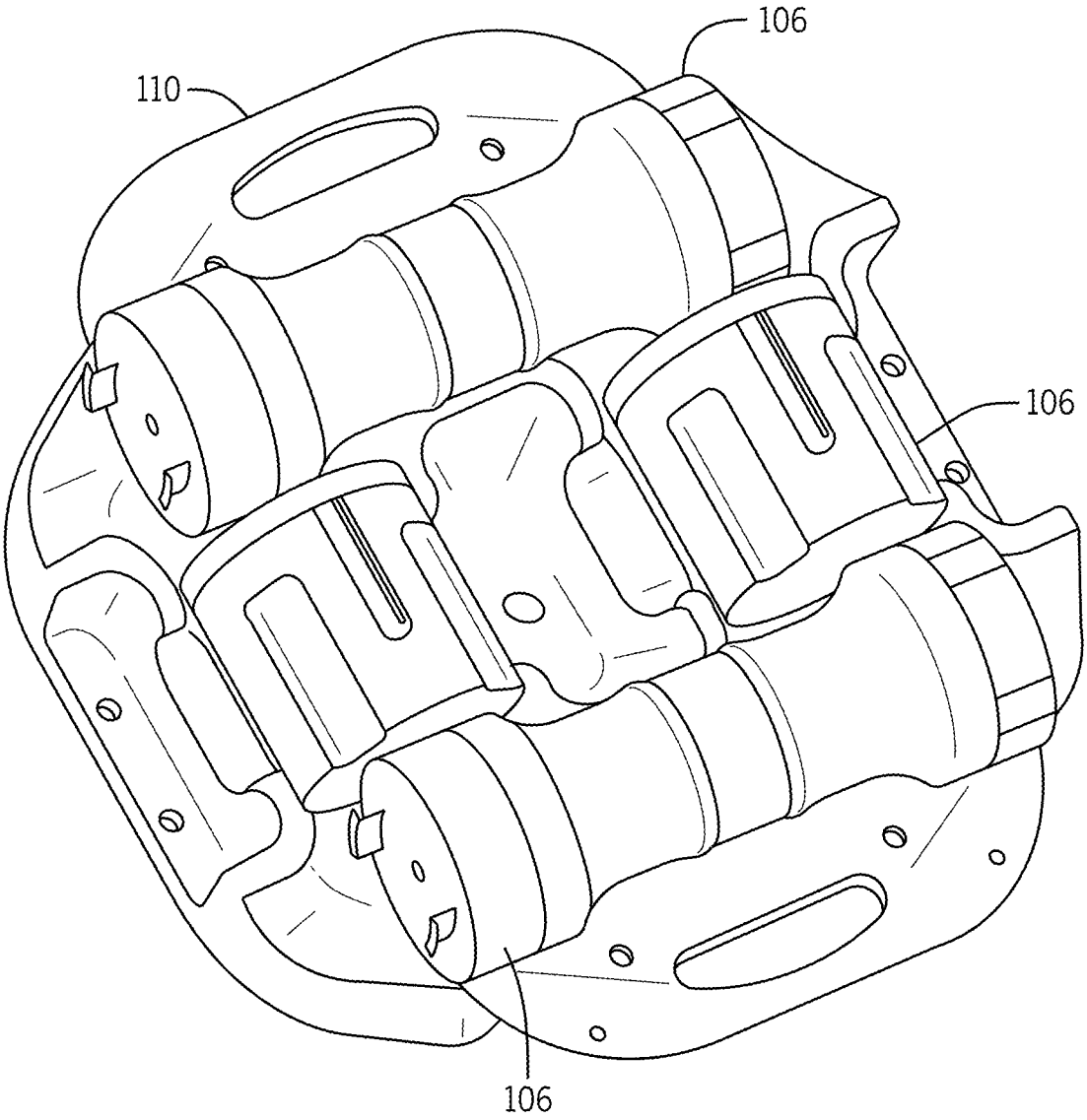

FIGS. 1A and 1B show a modular post 100. The modular post 100 comprises a post component 105 and a base 110. The modular post 100 is operable in and/or moveable between a deployed configuration and a stored configuration. In the embodiment shown, the modular post 100 is for use in a barrier system. Barrier systems often provide a vital safety function, for example acting to demarcate an area where industrial work is taking place to ensure that both staff and members of the public are protected. The modular post 100 is therefore configured to remain stable and in place, and resist being knocked over or moved due to either inclement weather conditions or inadvertent contact from persons or objects. However, it will be appreciated that the modular post 100 may also be employed for other uses and applications.

FIG. 1A shows the modular post 100 in the deployed configuration. In the deployed configuration, the post component 105 is configured to connect to the base 110 and extend from the base 110 to form a post when the base 110 is placed on a surface, such as a floor or ground surface. In the embodiment shown, the post component 105 is configured to connect to the base 110 such that the post component 105 extends substantially perpendicularly (at an angle of substantially 90°) from the base 110, to form a substantially upright post when the base 110 is placed on a floor surface. Alternatively, the post component 105 may be configured to connect to the base 110 such that the post component extends from the base 110 at a different angle, but may still extend from the base 110 to form a post when the base 110 is placed on a floor/ground surface.

FIG. 1B shows the modular post 100 in the stored configuration. In the stored configuration, the post component 105 is configured to be received or nested within the base 110.

In the embodiment shown, the post component 105 is operable in and moveable between a first configuration and a second configuration. The post component 105 is configured to be placed in the first configuration when the modular post 100 is in the deployed configuration. The post component 105 is configured to be placed in the second configuration when the modular post 100 is in the stored configuration. In the embodiment shown, the post component 105 comprises a plurality of segments 106 which are separable from one another. In the first configuration, the segments 106 are connected to one another to form an elongate structure. In the stored configuration, the segments 106 are separated from one another in order to reduce at least one dimension of the post component 105, such that the post component 105 can be received within the base 110. In the embodiment shown, each segment 106 is configured to be received within the base 110 separately when the modular post 100 is in the stored configuration. None of the segments 106 may remain connected to one another when the post component 105 is in the second configuration and received within the base 110. Alternatively, two or more of the segments 106 may remain connected to one another when the post component 105 is in the second configuration to be received within the base 110.

Alternatively, the post component 105 may comprise a plurality of segments 106 that remain connected to another (or are not separable from one another) whether the post component 105 is in the first configuration or the second configuration. For example, the post component 105 may have or comprise a telescopic structure. The telescopic structure of the post component 105 may enable the post component 105 to be extended in the first configuration to form an elongate structure. The telescopic structure of the post component 105 may enable the post component 105 to be collapsed in the second configuration, with the segments 106 nested within one another. For a post component 105 having a telescopic structure, the post component 105 may therefore be received in the base 110 as a single entity. Alternatively, two or more of the segments 106 may be hingedly connected to one another. The segments 106 may fold relative to one another to move the post component 105 between the first configuration and the second configuration, and may remain connected to one another in both the first configuration and the second configuration.

Alternatively, depending on a height of the post component 105 when the modular post 100 is in the deployed configuration (relative to a size of the base 110), the post component 105 may not be operable in a first configuration and a second configuration. The post component 105 may remain in a single configuration, whether the modular post 100 is in the deployed configuration or the stored configuration.

Figure 2:
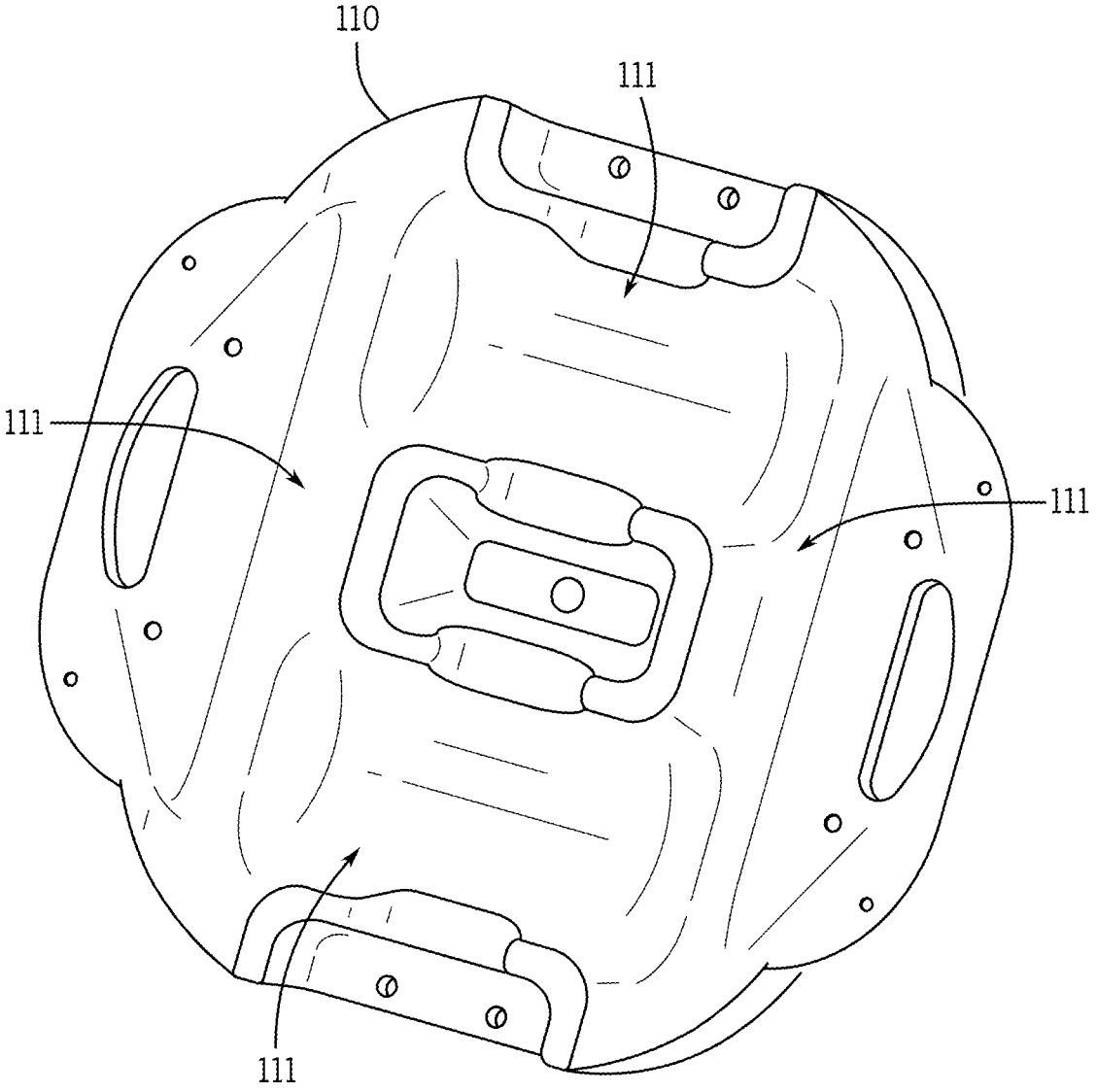
FIG. 2 shows an embodiment of a base of a modular post in accordance with the invention, the base having a plurality of recesses.

FIG. 2 shows the base 110 of the modular post 100 in more detail. In the embodiment shown, the base 110 comprises recesses 111 each configured to receive or house a segment 106 of the post component 105 when the modular post 100 is in the stored configuration. The recesses 111 each have a shape corresponding to or complementary to at least a part of a segment 106 of the post component 105. For example, the recesses 111 may each be shaped to contact at least a part of an outer surface of a segment 106 when the segment 106 is received within the recess 111. In the embodiment shown, the recesses 111 are arranged relative to one another to enable the segments 106 to be received within the base 110 in a substantially square arrangement (as shown in FIG. 1B). That may enable the total length of the post component 105 to be received within the base 110 in a spatially efficient manner. Alternatively, the recesses 111 may be arranged such that the segments 106 are aligned substantially parallel to one another when the segments 106 are received within the base 110.

Alternatively, the base 110 may simply comprise a single cavity configured to receive all segments 106 of the post component 105. The cavity may not comprise separate recesses 111 configured to receive separate segments 106 of the post component 105. In embodiments with a single post component 105, a single cavity or recess 111 may be provided to receive the post component 105.

Figure 3A:
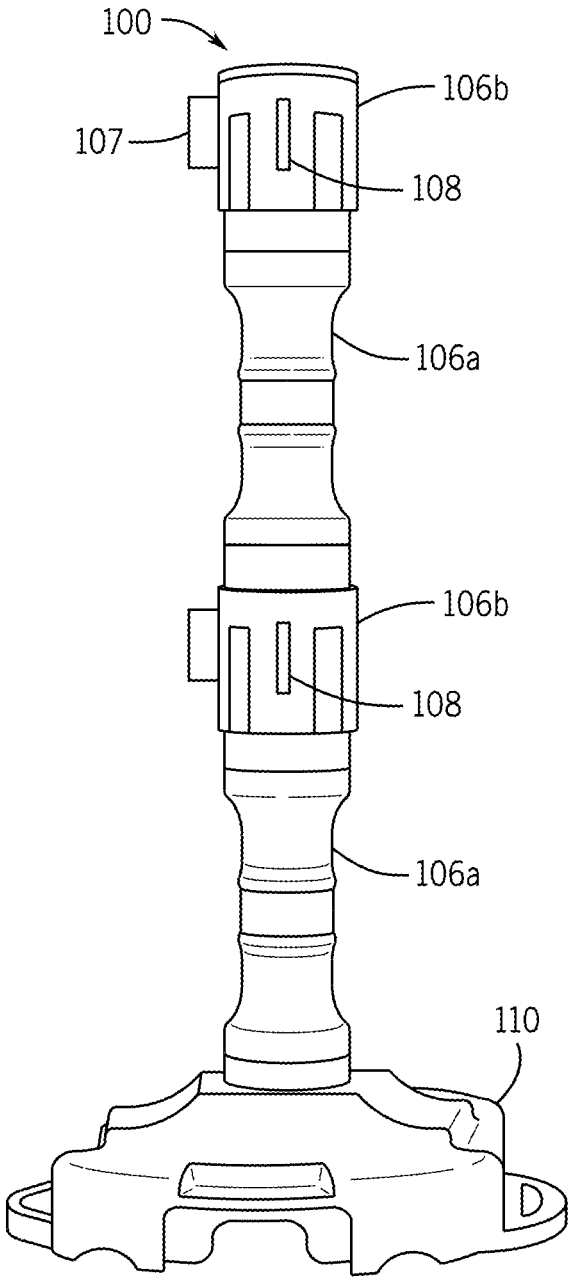
FIGS. 3A to 3E show an embodiment of a modular post in accordance with the invention, the modular post having a post component with different types of post segments.
Figure 3B:
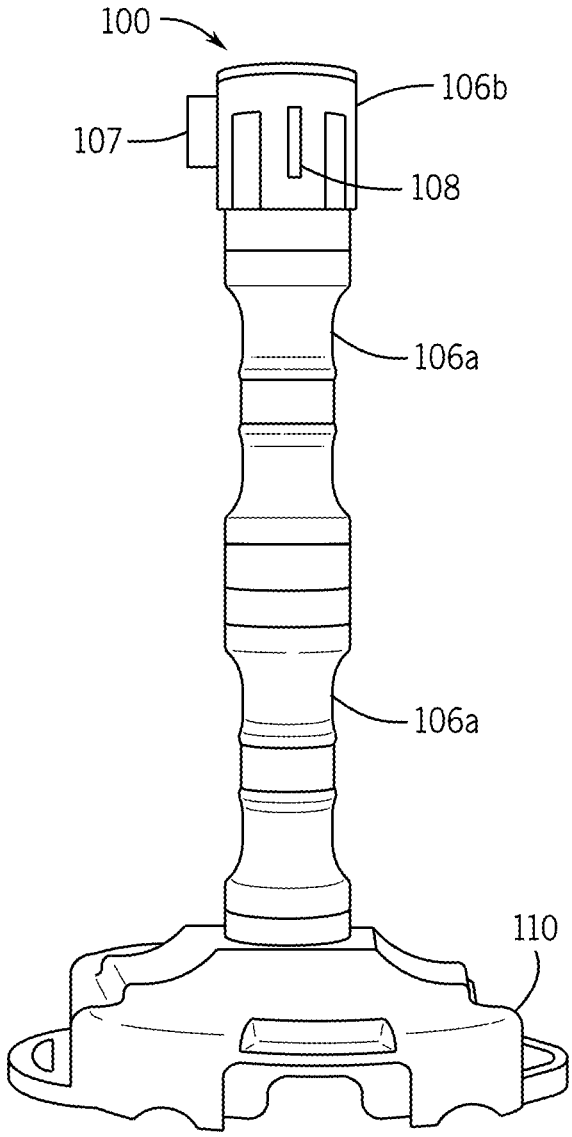

FIGS. 3A and 3B show the post component 105 in more detail. In the embodiment shown, the post component 105 comprises first post segments 106*a* and second post segments 106*b*. One or more of each of the first post segments 106*a* and second post segments 106*b* may be provided. In other embodiments the post component may comprise only one or more first post segments 106*a*, or one or more second post segments 106*b*.

In the embodiment shown, the purpose of the first post segments 106*a* is to provide a length of post. In the embodiment shown, the first post segments 106*a* have a greater length than the second post segments 106*b*. Alternatively, the first and second post segments 106*a*, 106*b* may have substantially the same length or the first post segments 106*a* may have a lesser length than the second post segments 106*b*. In the embodiment shown, each first post segment 106*a* comprises a substantially cylindrical shape. Each end portion of the first post segment 106*a* comprises a greater diameter than a central portion of the first post segments 106*a*, giving the first post segment 106*a* an overall dumbbell shape. Alternatively, the first post segment 106*a* may have any suitable shape, such as a cylinder (i.e. without the dumbbell configuration), elliptical cylinder, triangular prism, square or rectangular prism or polygonal prism etc.

In the embodiment shown, the purpose of the second post segments 106*b* is to provide a length of post and also to provide a barrier function. In the embodiment shown, each second post segment 106*b* is or comprises a retractable barrier unit containing a retractable barrier (for example, a retractable tape). In the embodiment shown, each second post segment 106*b* has a substantially cylindrical shape. The retractable barrier unit of each second post segment 106*b* operates as a conventional retractable barrier unit. An end of the retractable barrier comprises a connector 107 configured to connect to a fixing point. The fixing point may be located on another post, such as another modular post 100, or on a fixed surface such as a wall. That may enable the formation of a barrier between the modular post 100 and the fixing point when the modular post 100 is in the deployed configuration. The retractable barrier of the second post segment 106*b* may be extended fully or partially from the retractable barrier unit in order to connect the connector 107 to a fixing point. In the embodiment shown, the connector 107 comprises a groove (not shown).

Figure 3C:
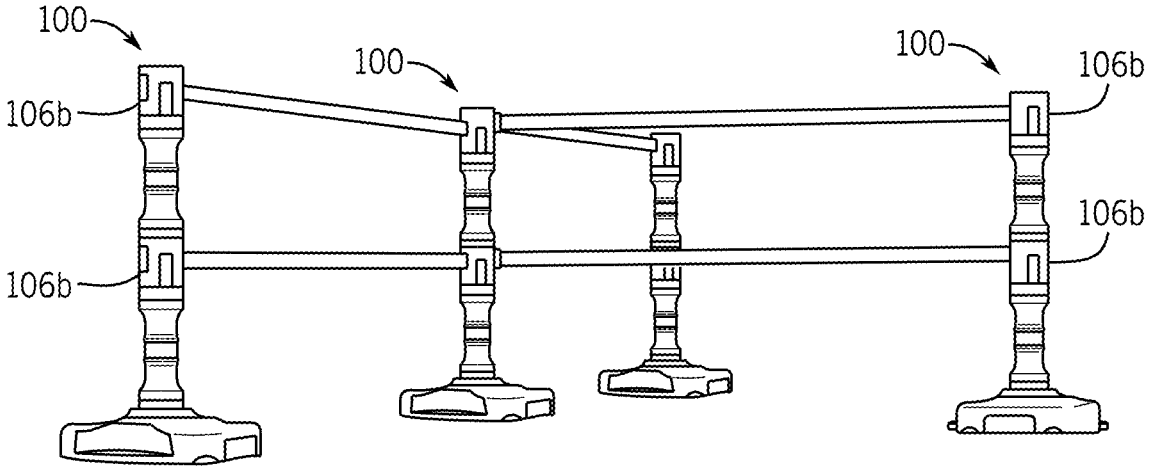
Figure 3D:
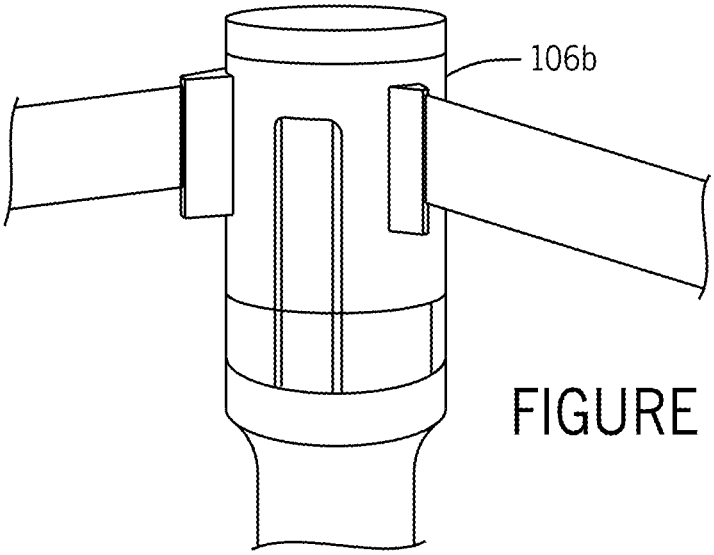
Figure 3E:
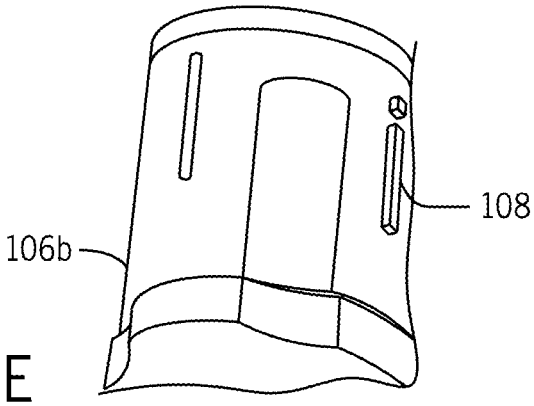

In the embodiment shown, an outer surface of each second post segment 106*b* comprises a plurality of fixing points 108. Each of the fixing points 108 is configured to connect to a retractable barrier such as the retractable barrier of a second post segment 106*b* of another modular post 100 (as shown in FIGS. 3C and 3D). Alternatively, an outer surface of each second post segment 106*b* may comprise only one fixing point 108. In the embodiment shown, each fixing point 108 comprises a tongue or flange extending from an outer surface of the second post segment 106*b* (as shown in FIG. 3E). The tongue or flange is configured to be received by a groove of a connector 107 of a retractable barrier such as a retractable barrier of a second post segment 106*b* of another modular post 100 (as shown in FIGS. 3C and 3D). In the embodiment shown, the groove of the fixing point 108 is configured to receive the tongue or flange of the connector 107 by aligning an end of the tongue or flange with an end of the groove, and sliding the groove over the tongue or flange.

Alternatively, the connectors 107 and the fixing points 108 may comprise any suitable connecting mechanism to connect to one another. For example, the connector 107 and fixing point 108 may comprise corresponding or complementary portions of connecting mechanisms such as a resilient clip, a snap fit connection or a friction connection.

FIG. 3A shows the post component 105 in the first configuration, formed from two first post segments 106*a* and second post segments 106*b*, connected end to end in an alternating pattern. That may provide a post component 105 configured to form a barrier at more than one position along a height of the post component 105, for example at substantially a mid-point of the post component 105 and an upper end of the post component 105 (as shown in FIG. 3C).

FIG. 3B also shows the post component 105 in the first configuration, but not employing all the post segments 106*a*, 106*b*. In FIG. 3B, the post component 105 is formed from two first post segments 106*a* and a second post segment 106*b* connected end to end, with the two first post segments 106*a* connected together and the second post segment 106*b* positioned at an upper end of the post component 105. That may provide a post component 105 configured to form a barrier only at a height of the upper end of the post component 105.

FIGS. 3A and 3B illustrate that the first and second post segments 106*a*, 106*b* can be interchangeably connected to one another in any order. For example, a first post segment 106*a* may be connected to either or both of another first post segment 106*a* and a second post segment 106*b*, and vice versa. That may enable an overall barrier height and/or barrier configuration provided (at least in part) by the modular post 100 to be tailored to particular circumstances as required.

Figure 4A:
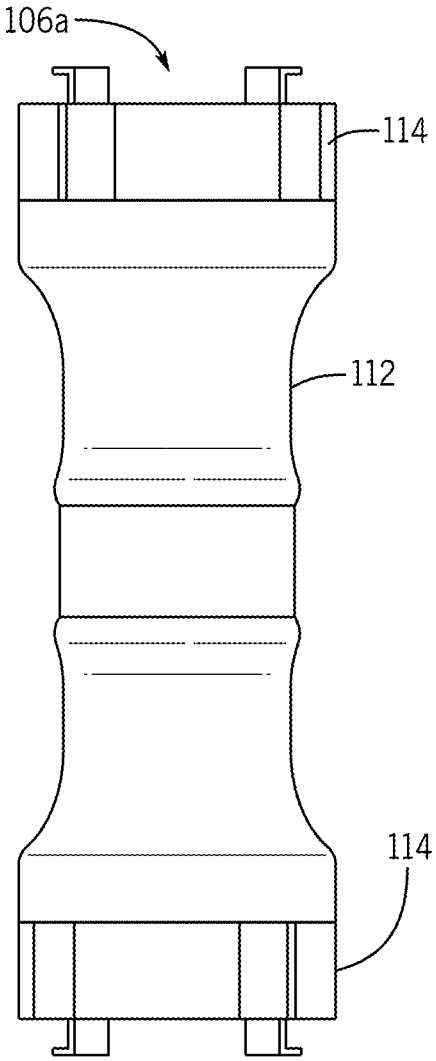
FIGS. 4A and 4B show an embodiment of a first post segment of a post component of a modular post in accordance with the invention.
Figure 4B:
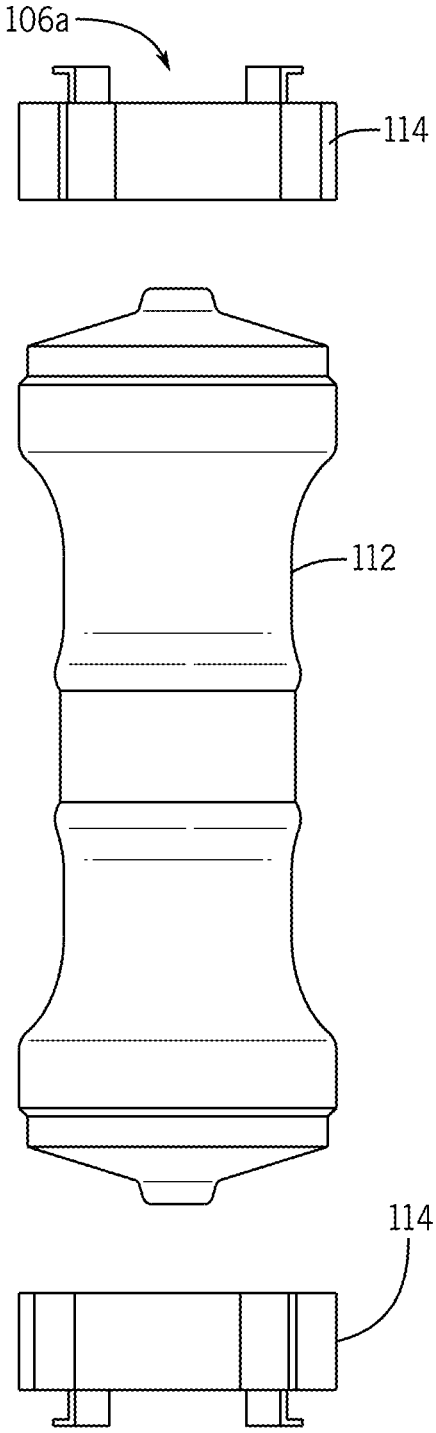

FIGS. 4A and 4B show a first post segment 106*a* in more detail. In the embodiment shown, the first post segment 106*a* comprises a body portion 112 and connecting portions 114 at either end of the body portion 112. The connecting portions 114 are releasably connectable to the body portion 112, as shown in FIG. 4B, for example via a snap fit connection or a threaded connection. Alternatively, the connecting portions 114 may be fixedly or permanently connected to, or integral to, the body portion 112. The connecting portions 114 enable the first post segment 106*a* to be connected, end to end, to another first post segment 106*a* and/or a second post segment, as shown in FIGS. 3A and 3B.

Figure 5:
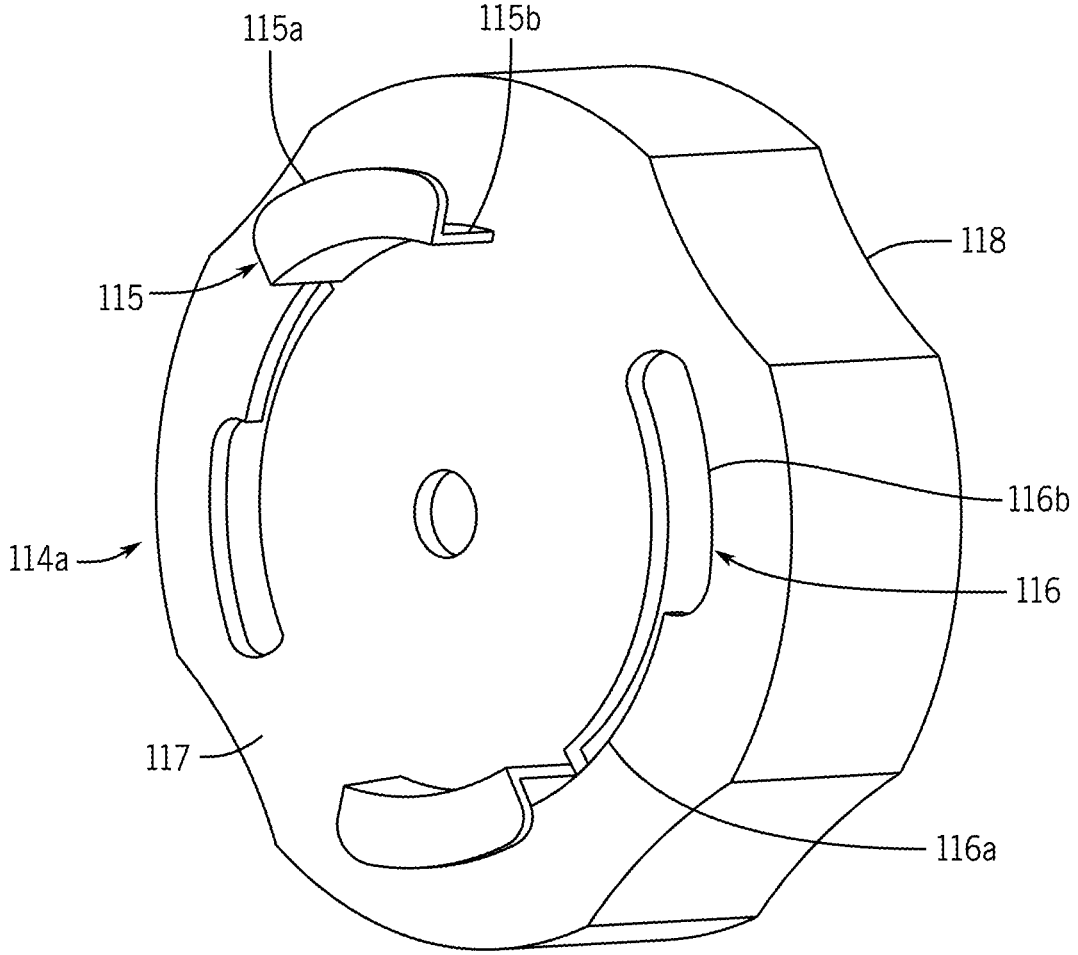
FIG. 5 shows an embodiment of a connecting portion of the first post segment of FIGS. 4A and 4B in accordance with the invention.

FIG. 5 shows a connecting portion 114 of the first post segment 106*a* of FIGS. 4A and 4B in more detail. The connecting portion 114 comprises a socket mechanism configured to connect to corresponding socket mechanisms of other connecting portions 114 (for example, on other first post segments 106*a*, or second post segments 106*b*).

In the embodiment shown, the connecting portion 114 comprises a planar surface 117 and a skirt 118 extending substantially perpendicularly from the planar surface 117. The connecting portion 114 also comprises a socket mechanism 114*a*. In the embodiment shown, the socket mechanism 114*a* is formed from a male socket portion 115 and a female socket portion 116.

The skirt 118 is configured to connect to the body portion 112 of the first post segment 106*a*. The skirt 118 is configured to extend from the planar surface 117 such that when the skirt 118 is connected to the body portion 112 of the first post segment 106*a*, the planar surface 117 is spaced from an end of the body portion 112 such that the socket mechanism can function as described below.

The male socket portion 115 comprises a substantially L-shaped projection extending from the planar surface 117. The male socket portion 115 extends from the planar surface 117 in a direction substantially opposite to a direction in which the skirt 118 extends from the planar surface. The L-shaped projection of the male socket portion comprises a locking tab 115*a* and a strut 115*b* on which the locking portion is mounted. The strut 115*b* is directly connected to and extends substantially perpendicularly from the planar surface 117, and spaces the locking tab 115*a* from the planar surface 117.

The female socket portion 116 comprises an aperture in the planar surface 117 having a locking region 116*a* and an access region 116*b*. The access region 116*b* is configured (for example, sized and/or shaped) to enable a locking tab 115*a* of a second connecting portion 114 to pass through the access region 116*a*.

A first connecting portion 114 (for example, of one first post segment 106*a*) can be connected to a second connecting portion 114 (for example, of another first post segment 106*a*) in the following manner. A locking tab 115*a* of the first connecting portion 114 may be passed through the access region 116*b* of the second connecting portion 114. The first connecting portion 114 may then be rotated relative to the second connecting portion to bring the locking tab 115*a* of the first connecting portion 114 into alignment with the locking region 116*a* of the second connecting portion 114. Once the locking tab 115*a* is aligned with the locking region 116*a*, the first connecting portion 114 is securely connected to the second connecting portion 114. To disconnect the first connecting portion 114 from the second connecting portion 114, the process may be reversed.

In the embodiment shown, each connecting portion 114 comprises two male socket portions 115 and two female socket portions 116. The two male socket portions 115 are arranged substantially opposite one another on the planar surface 117. The two female socket portions 116 are also arranged substantially opposite one another on the planar surface 117. The male socket portions 115 are oriented at substantially 90° to the female socket portions 116 on the planar surface 117. That may enable the male socket portions 115 of one connecting portion 114 to engage with the female socket portions 116 of another connecting portion 114, without the male socket portions 115 of the respective connecting portions 114 interfering with one another. Alternatively, each connecting portion 114 may comprise additional male 115 and female 116 socket portions, for example arranged on a circular path on the planar surface 117 along which connecting portions 114 are rotated in order to connect to and disconnect from one another. Alternatively, each connecting portion 114 may comprise a single male socket portion 115 and a single female socket portion 116.

Each second post segment 106*b* may comprise a socket mechanism 114*a* having only female socket portions 116 (as described above) at either end of the second post segment 106*b*. That may enable the second post segment 106*b* to connect to one or more first post segments 106*a*, but not to other second post segments 106*b*. Alternatively, each second post segment 106*b* may comprise a socket mechanism 114*a* having both male socket portions 115 and female socket portions 116 at either end of the second post segment 106*b*. That may enable the second post segment 106*b* to connect to a first post segment 106*a* and/or another second post segment 106*b*.

The socket mechanism 114*a* described above may enable the first 106*a* and second 106*b* post segments to simply, reliably and securely connect to one another to place the post component 105 in the first configuration. Alternatively, the post segments 106*a*, 106*b* may be connectable to one another using a different connection mechanism, such as a resilient clip, a snap fit connection or a friction fit connection.

Figure 6A:
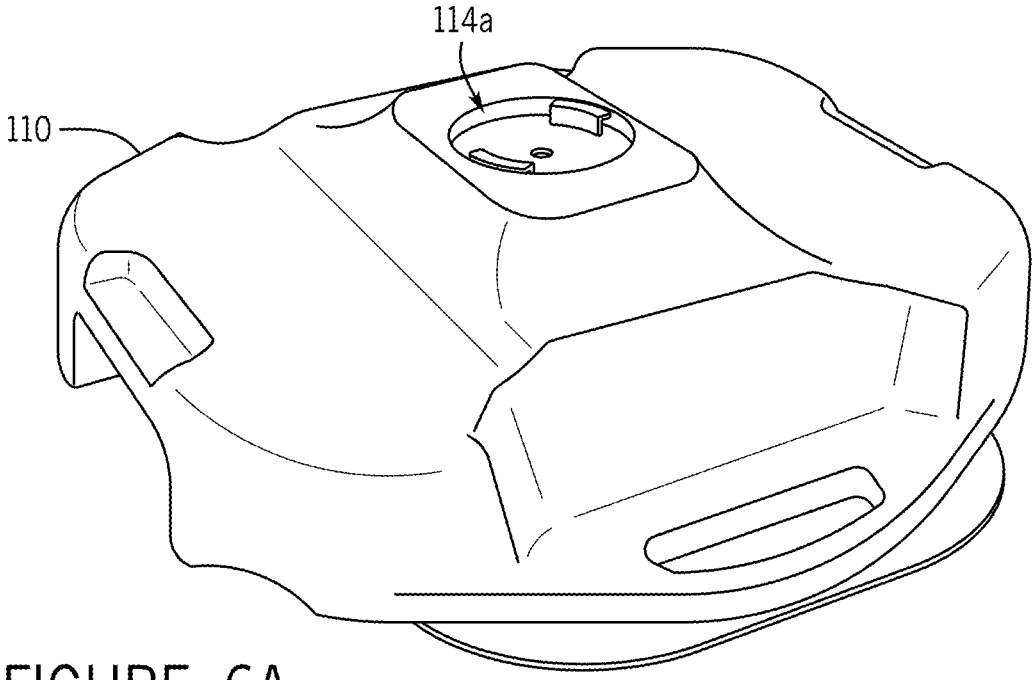
FIGS. 6A to 6C show embodiments of a base configured to connect to a post component in accordance with the invention.
Figure 6B:
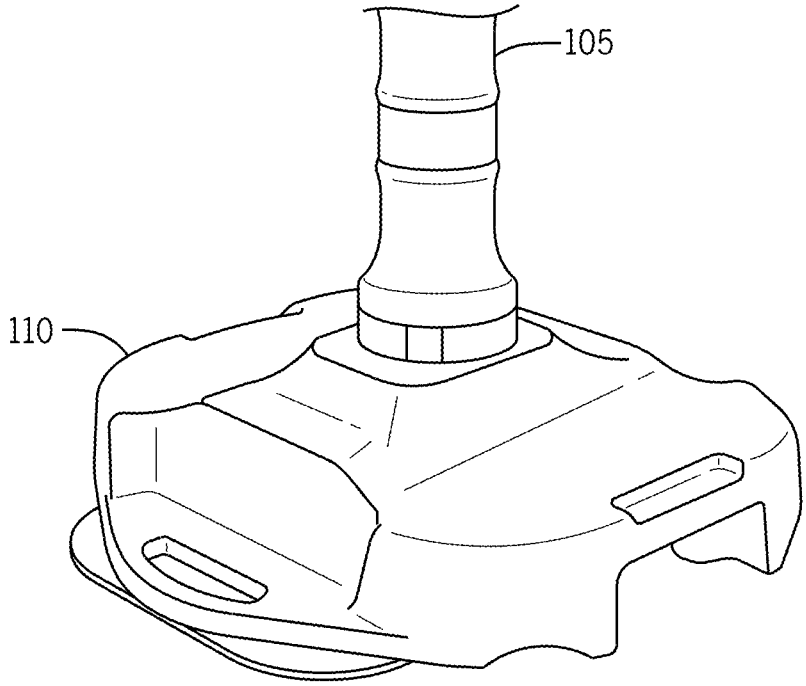

FIG. 6A shows the base 110 in more detail. FIG. 6B shows the post component 105 connected to the base 110. In the embodiment shown, the base 110 comprises a socket mechanism 114*a* as described above. The socket mechanism 114*a* is disposed on an opposite surface of the base 110 to the recesses 111. The socket mechanism 114*a* is configured to engage with a socket mechanism 114*a* located on a post segment 106*a*, 106*b* (as described above), in order to connect the post component 105 to the base 110. When the socket mechanism 114*a* located on the post component 105 is engaged with the socket mechanism 114*a* on the base 110, the post component 105 is secured in position and the modular post 100 is in the deployed configuration.

Figure 6C:
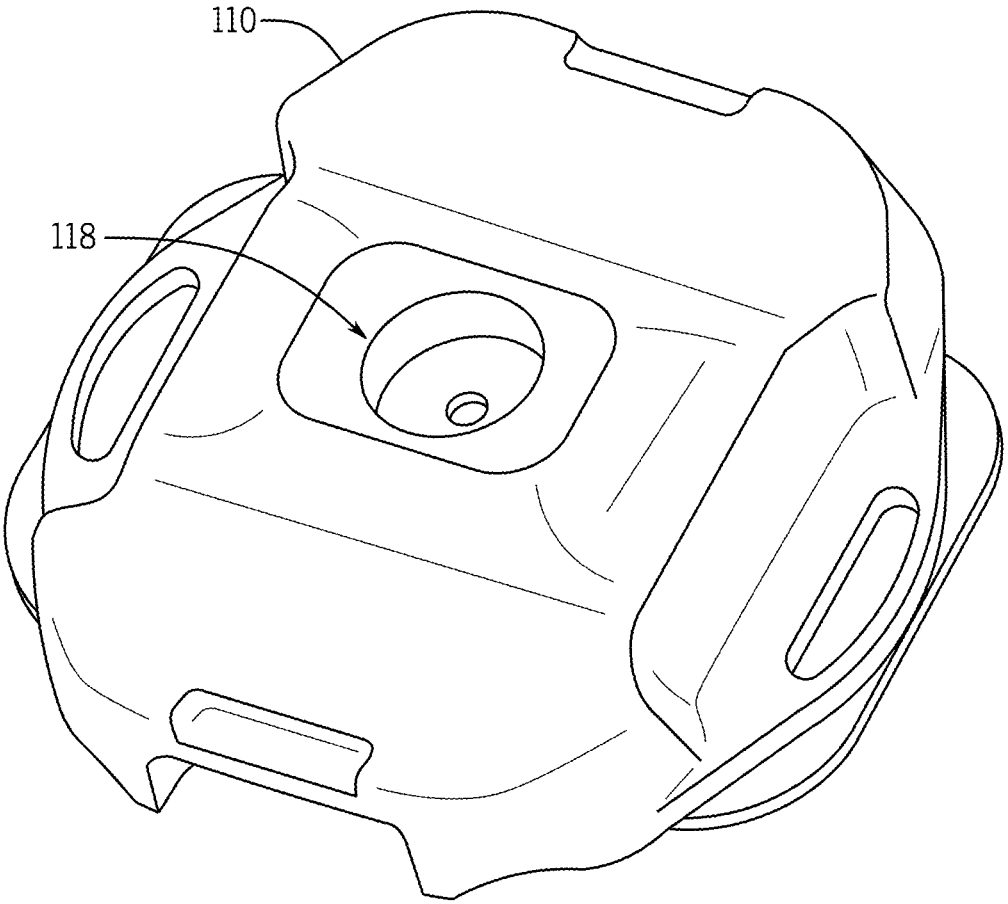

FIG. 6C shows an alternative mechanism for connecting the post component 105 to the base 110. In the embodiment shown, a top surface of the base 110 comprises a recess 118. The recess 118 is configured to receive at least a part of a length of the post component 105. The recess 118 may be configured to form a friction fit with the post component 105 when the post component 105 is received within the recess 118. Alternatively, the recess 118 may have a depth sufficient to prevent inadvertent removal of the post component from the recess 118. When the post component 105 is received or located in the recess 118, the post component 105 is secured in position and the modular post 100 is in the deployed configuration. In the embodiment shown, the recess 118 has a substantially circular cross-section. Alternatively, the recess 118 may have a cross-sectional shape corresponding to a cross-sectional shape of at least a part of the post component 105.

Figure 7A:
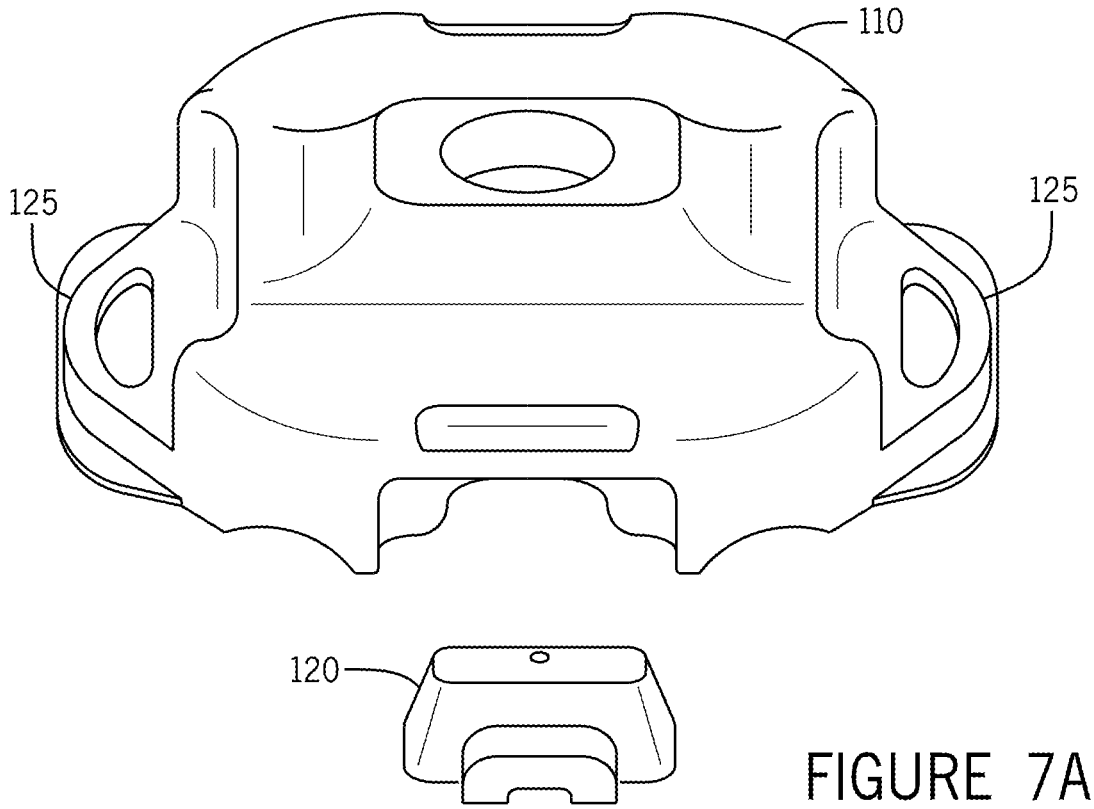
FIGS. 7A and 7B show an embodiment of a weighted base in accordance with the invention.
Figure 7B:
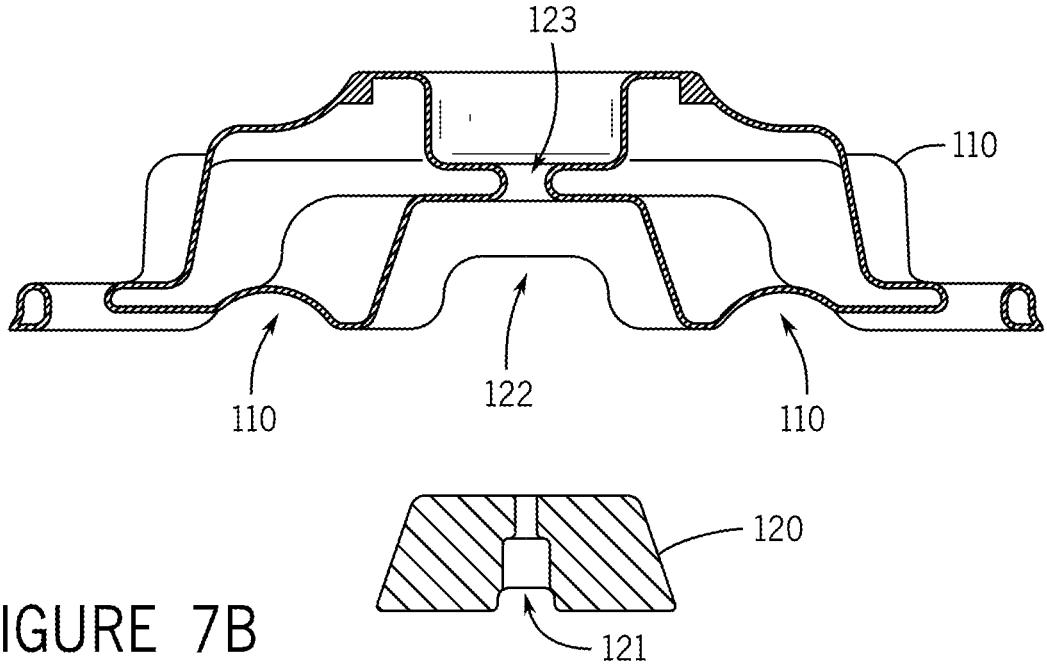

FIGS. 7A and 7B show the base 110 in further detail. In the embodiment shown, the base 110 is weighted. The base 110 being weighted may increase stability of the modular post 100 when the modular post 100 is in the deployed configuration. A weighted base 110 may lower a centre of mass of the modular post 100, reducing a likelihood of the modular post 100 tipping over if inadvertently knocked or subjected to inclement weather.

In the embodiment shown, the modular post 100 further comprises a weight 120. The weight 120 is configured to be received within the base 110. In the embodiment shown, the base 110 comprises a recess 122 configured to receive the weight 120. The recess 122 has a shape corresponding to or complementary to at least a part of the weight 120. For example, the recess 122 may be configured or shaped to contact at least a part of an outer surface of the weight 120 when the weight 120 is received within the recess 122. In the embodiment shown, the weight 120 is removably connectable to the base 110. The weight 120 comprises a through-hole 121. When the weight 120 is received within the recess 122, the through-hole is configured to align with a through-hole 123 in the base 110. An attachment means such as a bolt (not shown) may be passed through the aligned through-holes 121, 123 to secure the weight 120 to the base 110. The attachment means may be removed to enable the weight 120 to be removed from the base 110. Alternatively, the weight 120 may be fixedly or permanently secured to the base 110.

Alternatively, the base 110 may be weighted using a weight integral to the base 110. For example, the base 110 may comprise one or more weighted portions (for example, metallic portions) around or over which a material is moulded to provide a finished shape of the base 110. The weighted portions may have a greater density than a density of the material which is moulded over or around the weighted portions. The weight portion may comprise a weighted plate (for example a metallic plate) formed in a shape substantially corresponding to a finished shape of the base 110, over which a coating material (for example, a polymeric material or rubber material) is moulded.

In the embodiment shown in FIGS. 1A-1C, 2, 3A-3C, 6A-6C, 7A and 7B, the base 110 also comprises handles 125. In the embodiment shown, two handles 125 are provided on opposing sides of the base 110. Alternatively, additional handles 125 may be provided on the base 110, or a single handle 125 may be provided on the base 110. The handles 125 may improve ease of transportation of the modular post 100, particularly when the modular post 100 is in the stored configuration. Alternatively, no handles are provided.

Figure 8:
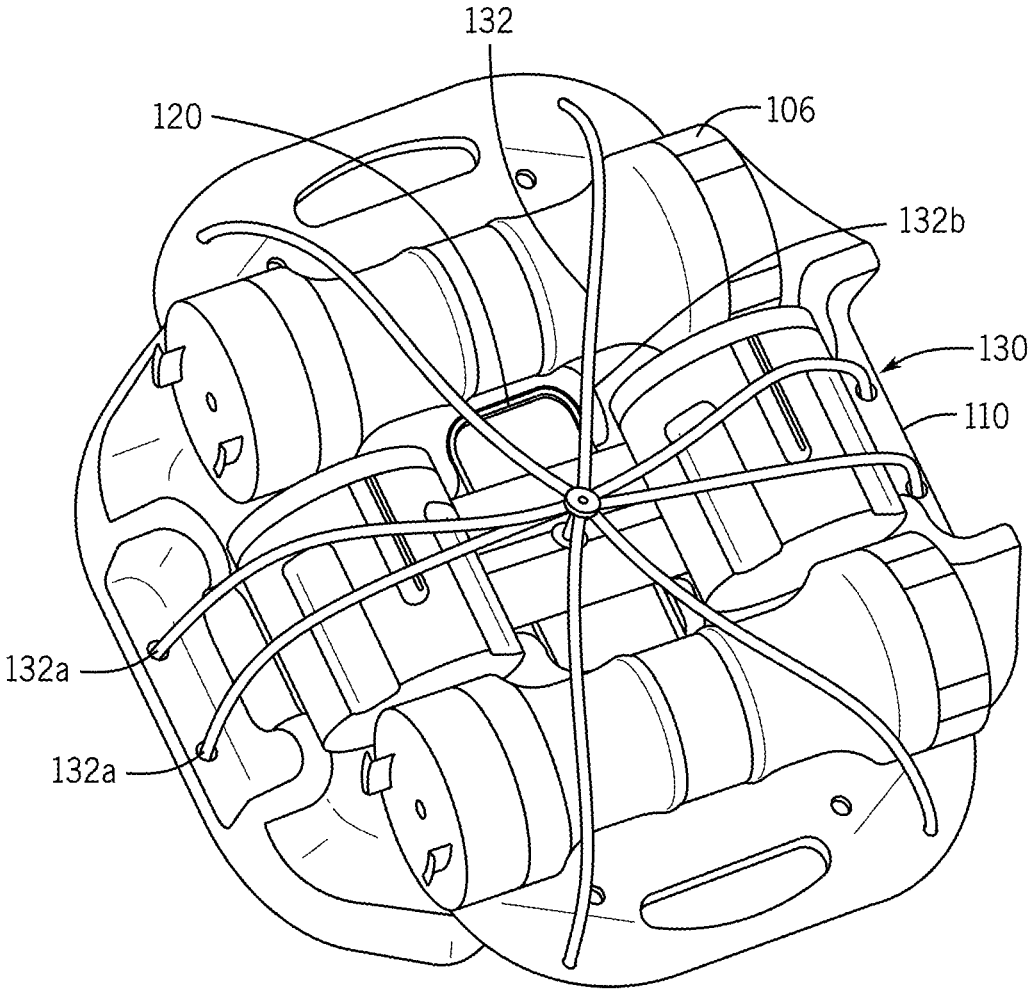
FIG. 8 shows an embodiment of modular post having a securing means in accordance with the invention.

FIG. 8 shows the modular post 100 in the stored configuration. A securing means 130 is provided to retain the post component 105 within the base 110 whilst the modular post 100 is in the stored configuration. In the embodiment shown, the securing means 130 comprises a plurality of elasticated members 132, such as elasticated ropes (commonly known as bungee cords). Each of the elasticated members 132 has a first end 132*a* and a second end 132*b*. The first end 132*a* of each elasticated member 132 is connectable to the base 110 adjacent an outer edge of the base 110. The first end 132*a* of each elastic member 132 is located at a different position from the first end 132*a* of each of the other elasticated members 132. The second end 132*b* of each elasticated member 132 is connectable to a substantially central location relative to the base 110, as shown in FIG. 8. When the first ends 132*a* and the second ends 132*b* of each elasticated member 132 are connected to the base, the elasticated members 132 are in an elongated state, with the elasticated members 132 pulled substantially taut. That arrangement creates a web or net of elasticated members 132 located over the segments 106 of the post component 105. The web or net of elasticated members 132 may prevent the segments 106 of the post component 105 from inadvertently being removed from the base 110 (for example, from being dislodged or removed from the recesses 111 of the base 110) whilst the modular post 100 is in the stored configuration.

In the embodiment shown, the weight 120 received within the base 120 provides the substantially central location to which the second ends 132*b* of the elasticated members 132 are connectable. Alternatively, the second ends 132*b* of the elasticated members 132 may be connectable to a substantially central point on the base 110 itself (for example, if the base 110 comprises an integral weight).

Alternatively, the securing means 130 may comprise a strap or webbing rather than a plurality of elasticated members 132. The strap or webbing may be flexible but not elastic. The strap or webbing may be connectable to opposing sides of the base 110 (for example, opposing outer edges of the base 110). When the strap or webbing is secured to the opposing sides of the base 110, the strap or webbing may act to retain the post component 105 within the base 110 when the modular post 100 is in the stored configuration. A plurality of straps may be employed, if necessary. Each of the straps may be connectable to opposing sides of the base 110. The plurality of straps may each be connectable to different pairs of opposing sides of the base 110, or to different positions on opposing sides of the base 110. Alternatively, the securing means 130 may comprise a plate or lid (not shown) configured to connect to the base 110 and form a substantially sealed space between the base 110 and the lid in which the post component 105 is secured. The lid may be configured to releasably connect to the base 110, for example via a resilient clip, or a snap fit connection, or using threaded connecting members such as screws or bolts. The lid may be hingedly connected to the base 110.

Alternatively, the post component 105 may be received in one or more recesses 111 of the base 110 using a snap fit or a friction fit or by providing one or more flexible and/or deformable retaining features such as lips or flanges. That may enable the post component 105 to be retained within the base 110 when the modular post 100 is in the stored configuration, without requiring a securing means 130.

In the embodiment shown in FIGS. 1 to 8, the post component 105 and the base 110 each comprise or are manufactured from polypropylene (PP). Alternatively, the post component 105 and/or the base 110 may comprise or be manufactured from a polymeric or plastic material, for example polyvinyl chloride (PVC), or alternatively from another suitable material such as a metallic material or wood.

Each of the second post segments 106*b* being separable from other segments 106 of the post component 105, as described above, may enable the second post segment 106*b* to alternatively be used independently from other parts of the modular post 100. For example, in areas or locations in which use of a modular post 100 would not be suitable or advisable, the second post segment 106*b* may still be employed to provide a barrier.

Figure 9A:
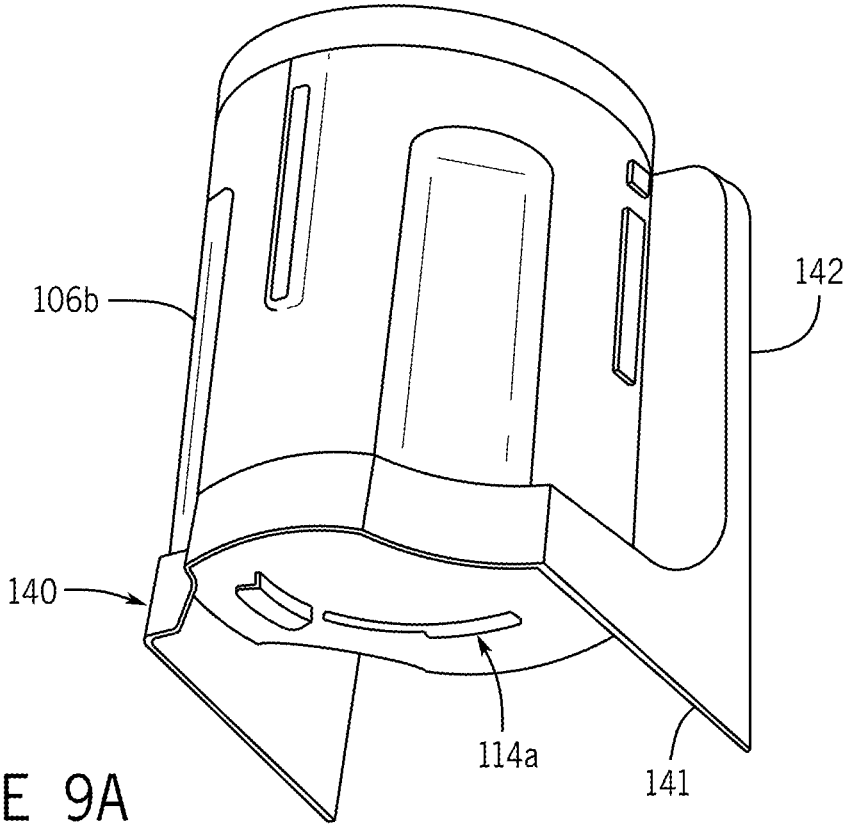
FIGS. 9A and 9B show an embodiment of a second post segment being used with a support bracket and a receiving plate in accordance with the invention.

FIG. 9A shows a second post segment 106*b* affixed to a support bracket 140. In the embodiment shown, the support bracket 140 comprises a base portion 141 and a back portion 142. The base portion 141 and the back portion 142 are arranged substantially perpendicularly to one another in the embodiment shown. The base portion 141 is configured to connect to and support the second post segment 106*b*. In the embodiment shown, the base portion 141 comprises a socket mechanism 114*a* as described above, enabling the support bracket 140 to releasably connect to the second post segment 106*b*. Alternatively, the second post segment 106*b* may be releasably connectable to the support bracket 140 using a different connection mechanism, as described above.

The back portion 142 of the support bracket 140 is configured to connect the support bracket 140 to an external body such as a wall, door, shelf or shelving unit or other body that is external to the modular post 100. The back portion 142 of the support bracket 140 may comprise one or more magnets or magnetic regions configured to interact magnetically with an external body to connect the support bracket 140 to the external body. Alternatively, the back portion 142 may comprise one or more apertures through which a connector such as a screw or bolt is configured to pass, in order to connect the support bracket 140 to the external body. Alternatively, other suitable connection mechanisms may be used to connect the support bracket 140 to an external body.

Alternatively, the support bracket 140 may only comprise a back portion 142. The back portion 140 may comprise a connector 107, as described above, configured to engage with a fixing point 108 on an outer surface of the second post segment 106*b*. The connector 107 may enable to the second post segment 106*b* to be releasably connectable to the support bracket 140 without requiring a base portion 141.

Once the second post segment 106*b* is securely connected to the support bracket 140, and the support bracket 140 is securely connected to an external body, the connector 107 at the end of the retractable barrier unit of the second post segment 106*b* may be connected to a fixing point as described above, in order to form a barrier.

Figure 9B:
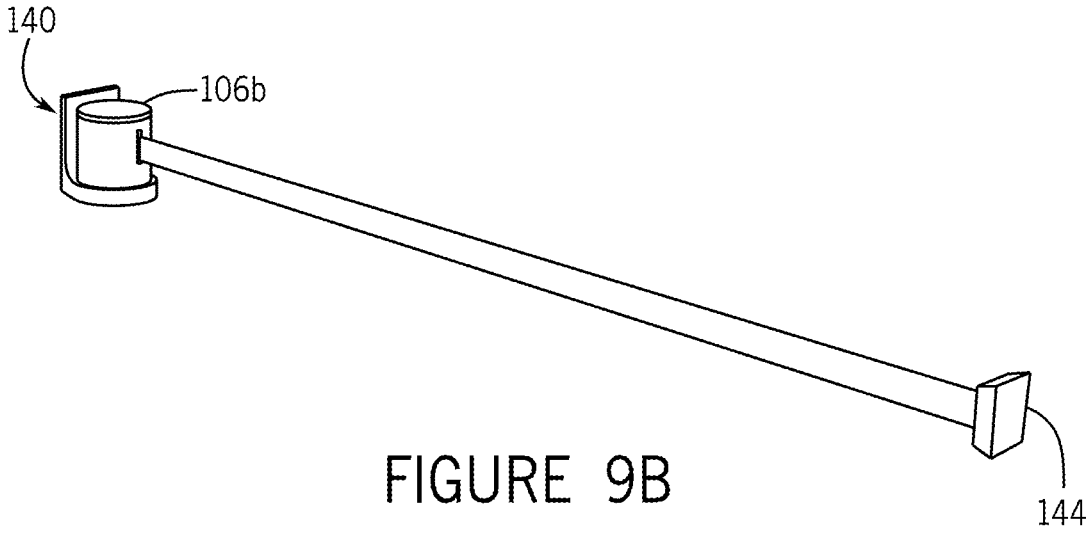

The fixing point to which the connector 107 of the retractable barrier unit of the second post segment 106*b* may be connected may be located or disposed on a receiver plate 144. FIG. 9B shows the connector 107 of the retractable barrier unit of the second post segment 106*b* connected to a fixing point on the receiver plate 44, with the second post segment 106*b* mounted on a support bracket 140.

In the embodiment shown, the receiver plate 144 comprises a substantially planar structure. The receiver plate 144 is configured to connect to an external body such as a wall, door, shelf or shelving unit or other body that is external to the modular post 100. Similar to the back portion 142 of the support bracket 140, the receiver plate 144 may comprise one or more magnets or magnetic regions configured to interact magnetically with an external body to connect the receiver plate 144 to the external body. Alternatively, the receiver plate 144 may comprise one or more apertures through which a connector such as a screw or bolt is configured to pass, in order to connect the receiver plate 144 to the external body. Alternatively, other suitable connection mechanisms may be used to connect the support bracket 140 to an external body.

Figure 10:
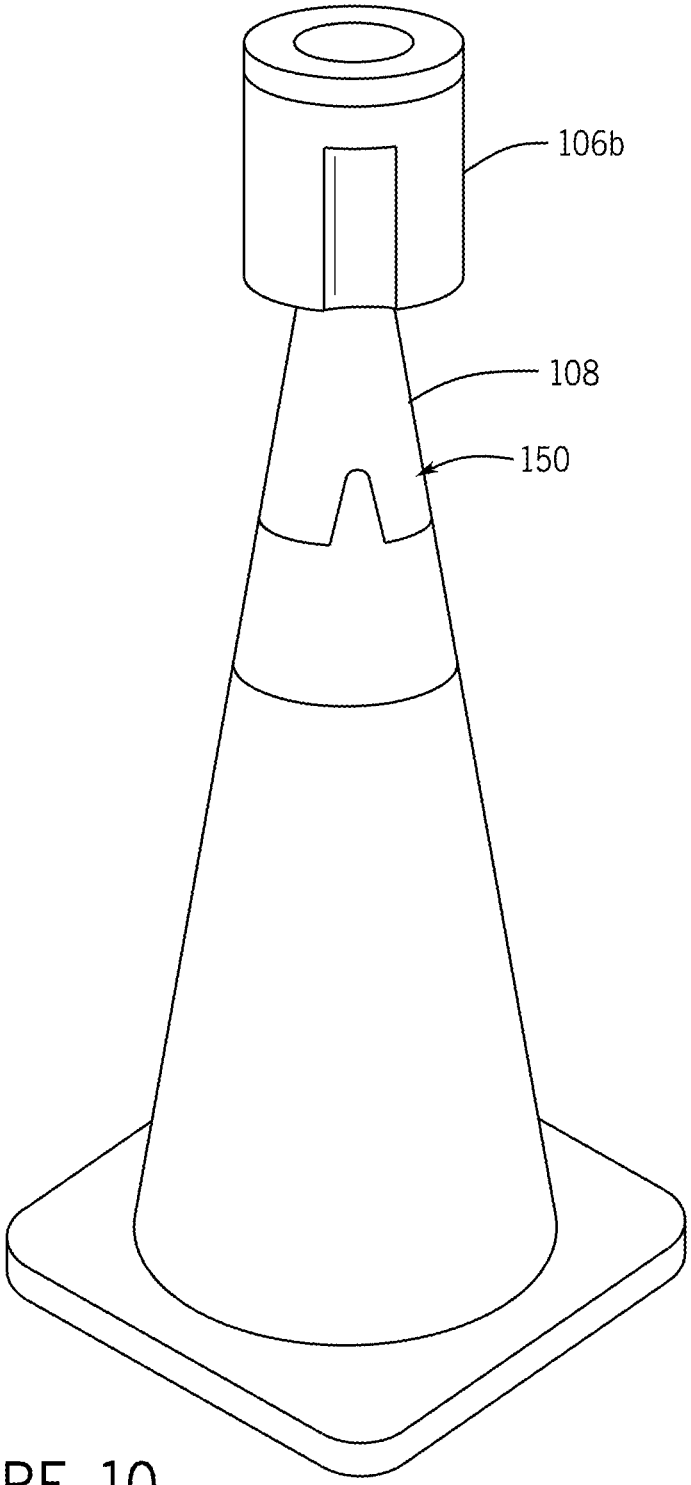
FIG. 10 shows an embodiment of a second post segment being used with a cone adaptor in accordance with the invention.

FIG. 10 shows the second post segment 106*b* mounted on a conventional traffic cone using a cone adaptor 150. The cone adaptor 150 is configured to be placed over a top portion of the traffic cone. The cone adaptor 150 comprises a recess configured to receive the top portion of the traffic cone. For example, the cone adaptor 150 may be configured to slide over a top portion of the traffic cone. The cone adaptor 150 is also configured to releasably connect to the second post segment 106*b*. The cone adaptor 150 may comprise a socket mechanism 114*a*, as described above, enabling the cone adaptor 150 to releasably connect to the second post segment 106*b* to securely mount the second post segment 106*b* on the traffic cone. Alternatively, the second post segment 106*b* may be releasably connectable to the cone adaptor 150 using a different connection mechanism, as described above.

In the embodiment shown, an outer surface of the cone adaptor 150 also comprises one or more fixing points 108 as described above. That may enable the cone adaptor 150 to be used independently from the second post segment 106*b*. The cone adaptor 150 may be able to connect to one or more retractable barrier units to form one or more barriers, for example by engaging a fixing point 108 on the outer surface of the cone adaptor 150 with a connector 107 of a retractable barrier unit, as described above. Alternatively or additionally, an outer surface of the cone adaptor 150 may comprise one or more loops or hooks configured to interact or engage with other barrier structures such as ropes, chains or tapes.

Figure 11:
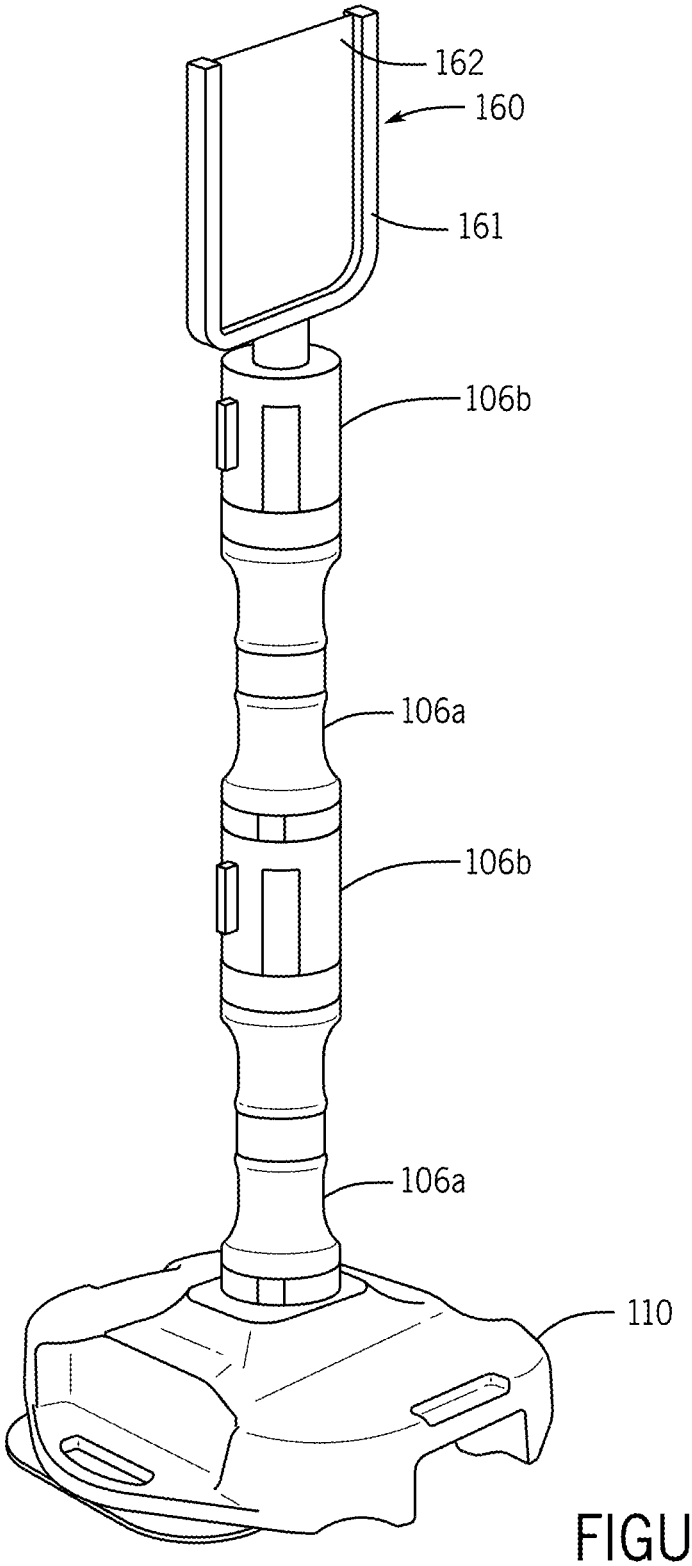
FIG. 11 shows an embodiment of a second post segment being used with a sign holder in accordance with the invention.

The second post segment 106*b* may also be configured to connect to a sign holder 160, as shown in FIG. 11. The second post segment 106*b* is configured to support the sign holder 160 to enable a sign to be visibly displayed in the sign holder 160.

In the embodiment shown, the sign holder 160 comprises a frame 161 and a backing plate 162. The backing plate 162 comprises a substantially rectangular shape. The frame 161 surrounds the backing plate 162 on three sides. The frame 161 also comprises a lip (not shown) spaced from a face of the backing plate 162. The lip spaced from the backing plate 162 provides a channel for receiving a sign (for example, a sheet of material) within the sign holder 160. The sign may be introduced into the channel from the side of the backing plate 162 which is not surrounded by the frame 161. The lip also acts to retain the sign within the sign holder 160.

The sign holder 160 is configured to releasably connect to the second post segment 106*b*. The sign holder 160 may comprise a socket mechanism 114*a*, as described above. Alternatively, the second post segment 106*b* may be releasably connectable to the cone adaptor 150 using a different connection mechanism, as described above. In FIG. 11, the sign holder 160 is shown connected to the second post segment 106*b* whilst the second post segment 106*b* is forming part of a modular post 100. Alternatively, the sign holder 160 may be connected to the second post segment 106*b* when the second post segment 106*b* is used independently from other parts of the modular post 100, such as when the second post segment is mounted on a support bracket 140 or a cone adaptor 150, as described above.

From reading the present disclosure, other variations and modifications will be apparent to the skilled person. Such variations and modifications may involve equivalent and other features which are already known in the art of posts for use in barrier systems or modular posts, and which may be used instead of, or in addition to, features already described herein.

Although the appended claims are directed to particular combinations of features, it should be understood that the scope of the disclosure of the present invention also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. For example, the second post unit may be provided separately, not for use with a modular post as claimed. The applicant hereby gives notice that new claims may be formulated to such features and/or combinations of such features during the prosecution of the present application or of any further application derived therefrom. Features of the devices and systems described may be incorporated into/used in corresponding methods. Where features are disclosed in connection with one embodiment of a modular post, it should be appreciated that any one or more or all of the same features may be incorporated in other embodiments of modular posts, instead of or in addition to the features described for the particular embodiment. That is, any and all combinations of features are envisaged, and are envisaged to be interchangeable, replaceable, added or removed.

For the sake of completeness, it is also stated that the term "comprising" does not exclude other elements or steps, the term "a" or "an" does not exclude a plurality, a single unit may fulfil the functions of several means recited in the claims and any reference signs in the claims shall not be construed as limiting the scope of the claims.

The invention claimed is:

1. A modular post for use in a barrier system, the post comprising:

a post component comprising a plurality of segments; and a base comprising a top side and an opposing bottom side, the bottom side comprising a deformable retaining feature and a recess having a shape substantially corresponding to the plurality of segments of the post component and configured to receive the plurality of segments separately in a stored configuration, the recess and the deformable retaining feature configured to form a friction fit with the post component when the modular post is in the stored configuration;

wherein the post component is configured to be attached or attachable on, to or in the top side of the base in a deployed configuration, and wherein the post component is configured to be housed within the base when the modular post is in the stored configuration.

2. The modular post of claim 1, wherein the post component is operable in and/or moveable between a first configuration in which the modular post is in the deployed configuration, and a second configuration in which the modular post is in the stored configuration.

3. The modular post of claim 1, wherein the plurality of segments are separable from one another.

4. The modular post of claim 1, wherein the post component comprises at least one retractable barrier unit configured to connect to one or more other posts.

5. The modular post of claim 4, wherein the at least one retractable barrier unit comprises a retractable tape unit.

6. The modular post of claim 1, wherein the base is weighted.

7. The modular post of claim 6, wherein:

i) the base comprises an integral weight; or ii) further comprising a weight configured to be received within the base, and optionally wherein the weight is separable from the base.

8. The modular post of claim 1, wherein the base comprises one or more handles.

9. The modular post of claim 1, further comprising a securing means to retain the post component within the base when the modular post is in the stored configuration.

10. The modular post of claim 9, wherein the securing means comprises one or more elasticated members.

11. The modular post of claim 1, wherein in the deployed configuration, the post component is attached or attachable on a top side of the base and, in stored configuration, the post component is configured to be removed from the top side of the base and to be housed within the base on a bottom side of the base, in which the top side of the base is opposite the bottom side of the base.

12. A method of using a modular post suitable for use in a barrier system according to claim 1, the method comprising:

providing a post component; and providing a base comprising a deformable retaining feature and a recess having a shape substantially corresponding to at least a part of a shape of the post component, the recess and the deformable retaining feature configured to form a friction fit with the post component when the modular post is in a stored configuration;

wherein the post component is configured to be attached or attachable on, to or in the base in a deployed configuration, and wherein the post component is configured to be housed within the base when the modular post is in the stored configuration.

13. The method of claim 12, comprising moving the modular post between a first configuration in which the modular post is in the deployed configuration, and a second configuration in which the modular post is in the stored configuration.

14. The method of claim 12, further comprising separating the post component into a plurality of post component segments and optionally storing each segment of the post component within the base separately when the modular post is in the stored configuration.

15. The method of claim 12, further comprising providing at least one retractable barrier unit configured to connect to one or more other posts and, optionally, wherein the at least one retractable barrier unit comprises a retractable tape unit.

16. The method of claim 12, further comprising weighting the base.

17. The method of claim 12, further comprising securing the post component within the base when the modular post is in the stored configuration.

18. The method of claim 12, wherein in the deployed configuration, the post component is attached or attachable on a top side of the base and, in stored configuration, the post component is configured to be removed from the top side of the base and to be housed within the base on a bottom side of the base, in which the top side of the base is opposite the bottom side of the base;

the method further comprising the steps of removing the post component from the top side of the base whilst the modular post is in the deployed configuration and thereafter storing the post component on the bottom side of the base.

19. A modular post for use in a barrier system according to claim 1, the base further comprising a securing means to retain the post component within the base when the modular post is in the stored configuration, the securing means selected from the group consisting of a strap, a webbing, and an elasticated member.

20. The modular post of claim 19, wherein the securing means has a first end and a second end;

the first end is connectable to the base adjacent an outer edge of the base; and the second end is connectable to a substantially central location relative to the base.

21. The modular post of claim 19, wherein in the deployed configuration, the post component is attached or attachable on a top side of the base and, in stored configuration, the post component is configured to be removed from the top side of the base and to be housed within the base on a bottom side of the base, in which the top side of the base is opposite the bottom side of the base.

22. A method of using a modular post suitable for use in a barrier system according to claim 1, the method comprising:

providing a post component; and providing a base comprising a securing means to retain the post component within the base when the modular post is in the stored configuration, the securing means selected from the group consisting of a strap, a webbing, and an elasticated member;

wherein the post component is configured to be attached or attachable on, to or in the base in a deployed configuration, and wherein the post component is configured to be housed within the base when the modular post is in the stored configuration.

23. The method of claim 22 further comprising connecting a first end of the securing means to the base adjacent an outer edge of the base; and connecting a second end of the securing means to a substantially central location relative to the base.

24. The method of claim 22, wherein in the deployed configuration, the post component is attached or attachable on a top side of the base and, in stored configuration, the post component is configured to be removed from the top side of the base and to be housed within the base on a bottom side of the base, in which the top side of the base is opposite the bottom side of the base;

the method further comprising the steps of removing the post component from the top side of the base whilst the modular post is in the deployed configuration and thereafter storing the post component on the bottom side of the base.

* * * * *